US008303427B1

(12) United States Patent
High

(10) Patent No.: US 8,303,427 B1
(45) Date of Patent: Nov. 6, 2012

(54) GOLF PUTTING PRACTICE AID ASSEMBLY

(76) Inventor: John C. High, Rockford, IL (US)

( * ) Notice: Subject to any disclaimer, the term of this patent is extended or adjusted under 35 U.S.C. 154(b) by 0 days.

(21) Appl. No.: 13/228,096

(22) Filed: Sep. 8, 2011

(51) Int. Cl.
*A63B 69/36* (2006.01)

(52) U.S. Cl. ..... 473/220; 473/119

(58) Field of Classification Search ..... 473/219–227, 473/257, 266, 267, 268
See application file for complete search history.

(56) References Cited

U.S. PATENT DOCUMENTS

| | | | | |
|---|---|---|---|---|
| 5,213,331 | A | 5/1993 | Avanzini | |
| 5,338,832 | A | 8/1994 | Pomato et al. | |
| 5,388,831 | A | 2/1995 | Quadri et al. | |
| 5,388,832 | A * | 2/1995 | Hsu | 473/220 |
| 5,464,221 | A | 11/1995 | Carney | |
| 5,611,739 | A * | 3/1997 | Carney | 473/220 |
| 5,709,609 | A * | 1/1998 | Carney | 473/220 |
| 5,725,440 | A | 3/1998 | Finney | |
| 6,123,626 | A | 9/2000 | Osborn | |
| 6,371,864 | B1 * | 4/2002 | Norwood | 473/220 |
| 7,118,488 | B2 * | 10/2006 | Chan et al. | 473/220 |
| 7,318,778 | B2 | 1/2008 | Owens | |
| D597,615 | S | 8/2009 | Graves | |

* cited by examiner

*Primary Examiner* — Nini Legesse

(57) ABSTRACT

A golf putting practice aid assembly for indicating a club face direction of a putter includes a golf putter that has a front club face and a rear club face. A holding member that has a front side, a back side, a top side, a bottom side and a pair of lateral sides each extending from the top side to the bottom side. The front side has a primary laser aperture extending therethrough. The back side has a secondary laser aperture extending therethrough. A mounting member is attached to the rear face. The mounting member is attached to the bottom side adjacent to the front side. The mounting member is used to elevate the holding member above the club face. A laser light emitter is removably inserted into the secondary laser aperture. The laser light emitter is emitting laser light directed forwardly out of the primary laser aperture.

3 Claims, 5 Drawing Sheets

GOLF PUTTING PRACTICE AID ASSEMBLY

BACKGROUND OF THE DISCLOSURE

Field of the Disclosure

The disclosure relates to golf putting practices devices and more particularly pertains to a new golf putting practice device for indicating a club face direction of a putter.

SUMMARY OF THE DISCLOSURE

An embodiment of the disclosure meets the needs presented above by generally comprising a golf putter that has a front club face and a rear club face. A holding member that has a front side, a back side, a top side, a bottom side and a pair of lateral sides each extending from the top side to the bottom side. The front side has a primary laser aperture extending therethrough. The back side has a secondary laser aperture extending therethrough. A mounting member is attached to the rear face. The mounting member is attached to the bottom side adjacent to the front side. The mounting member is configured to elevate the holding member above the club face. A laser light emitter is removably inserted into the secondary laser aperture. The laser light emitter is emitting laser light directed forwardly out of the primary laser aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
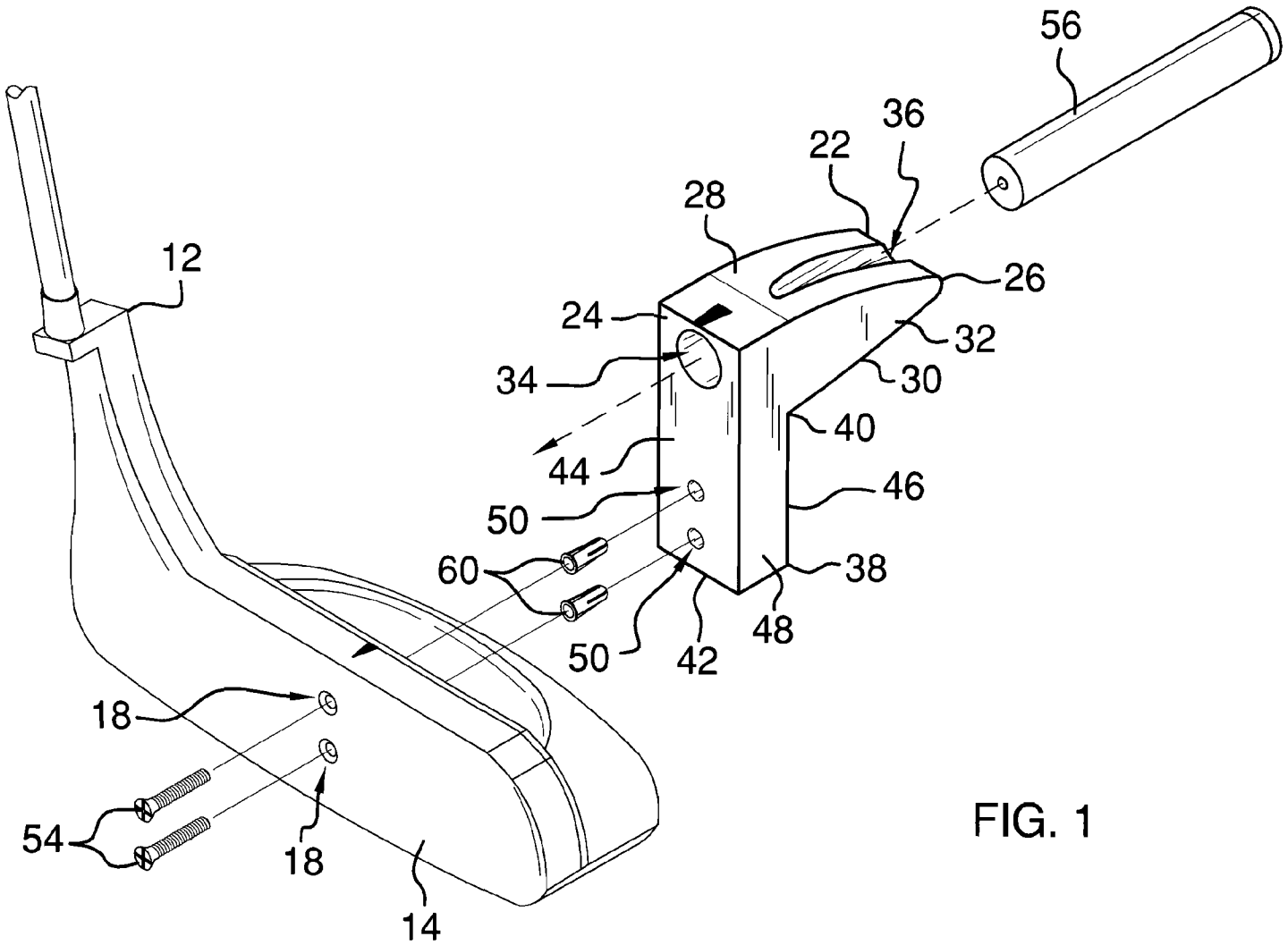
FIG. 1 is an exploded view of a golf putting practice aid assembly according to an embodiment of the disclosure.
Figure 2:
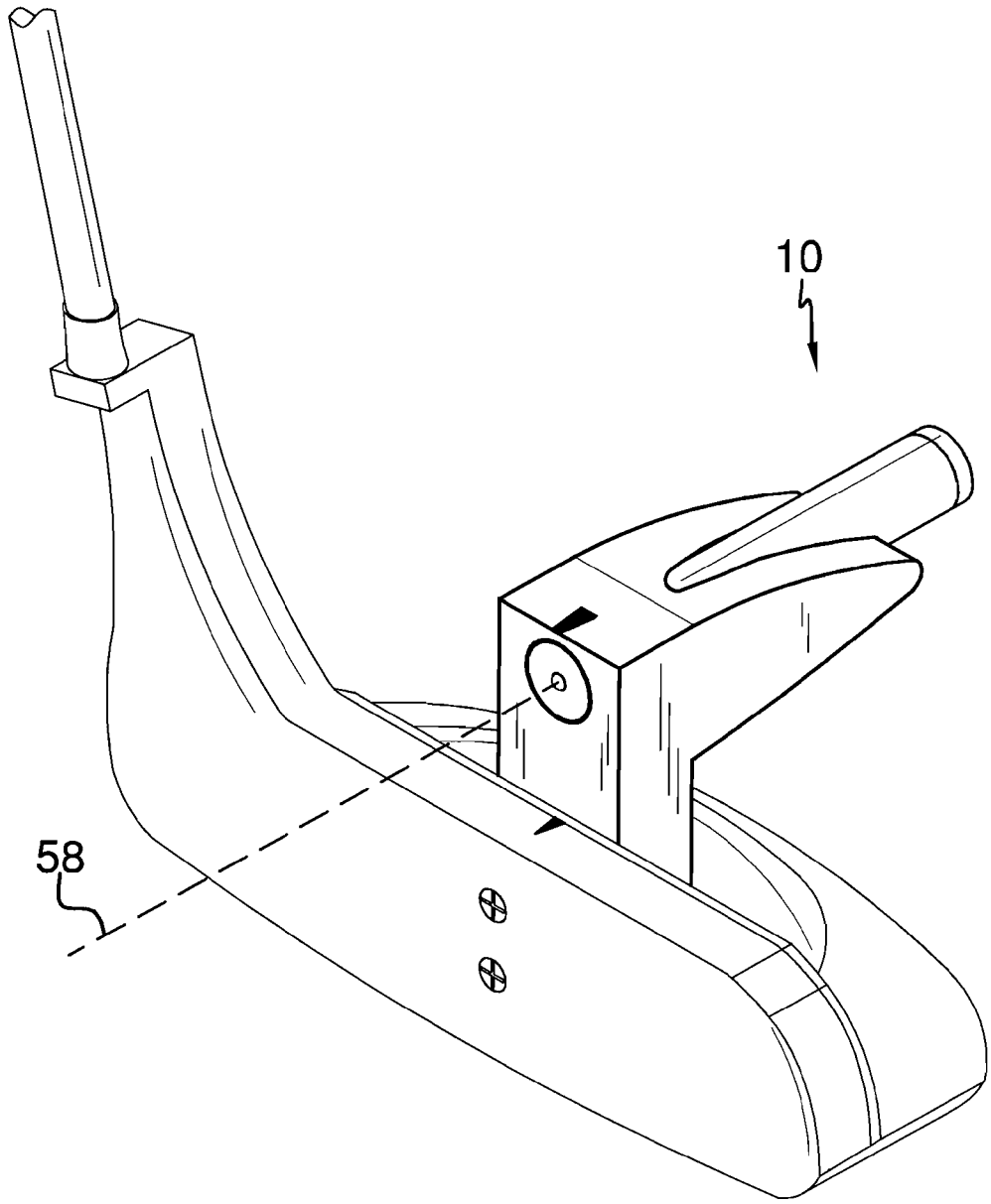
FIG. 2 is a front perspective view of an embodiment of the disclosure.
Figure 3:
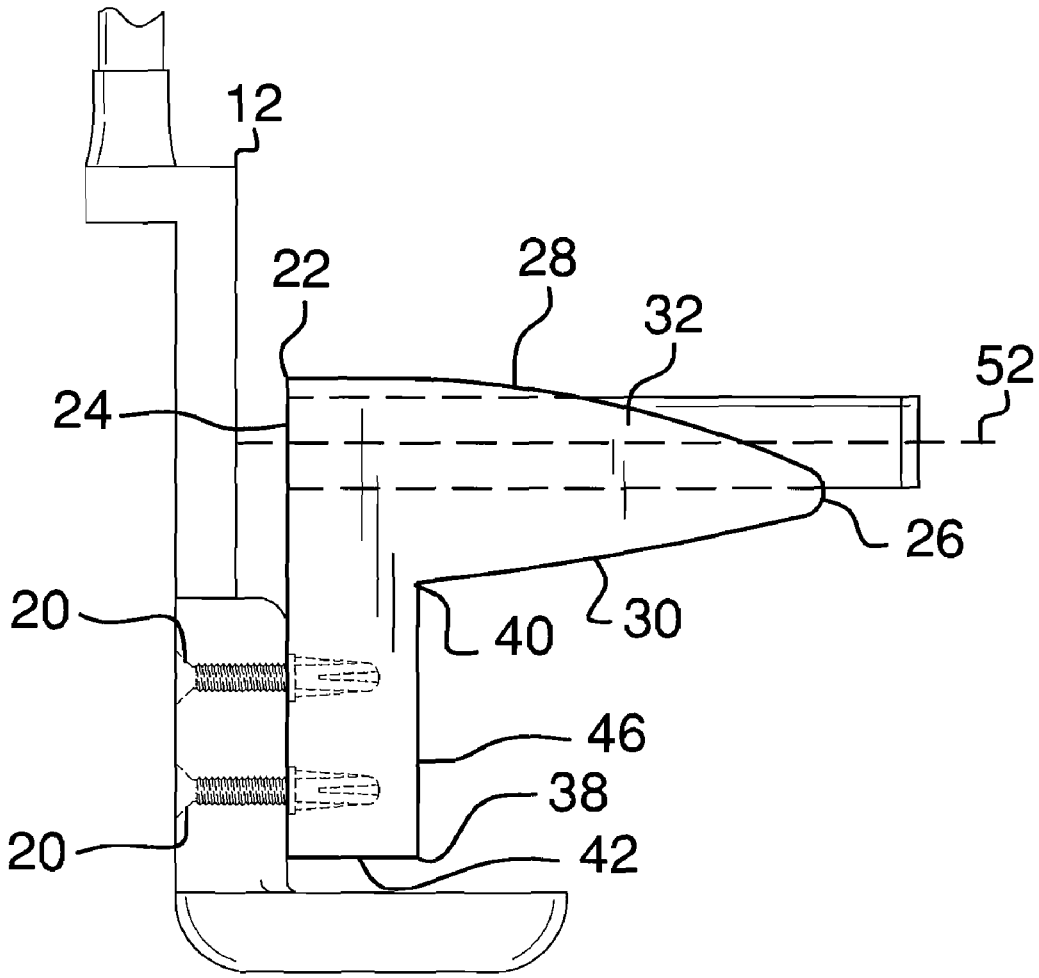
FIG. 3 is a side view of an embodiment of the disclosure.
Figure 4:
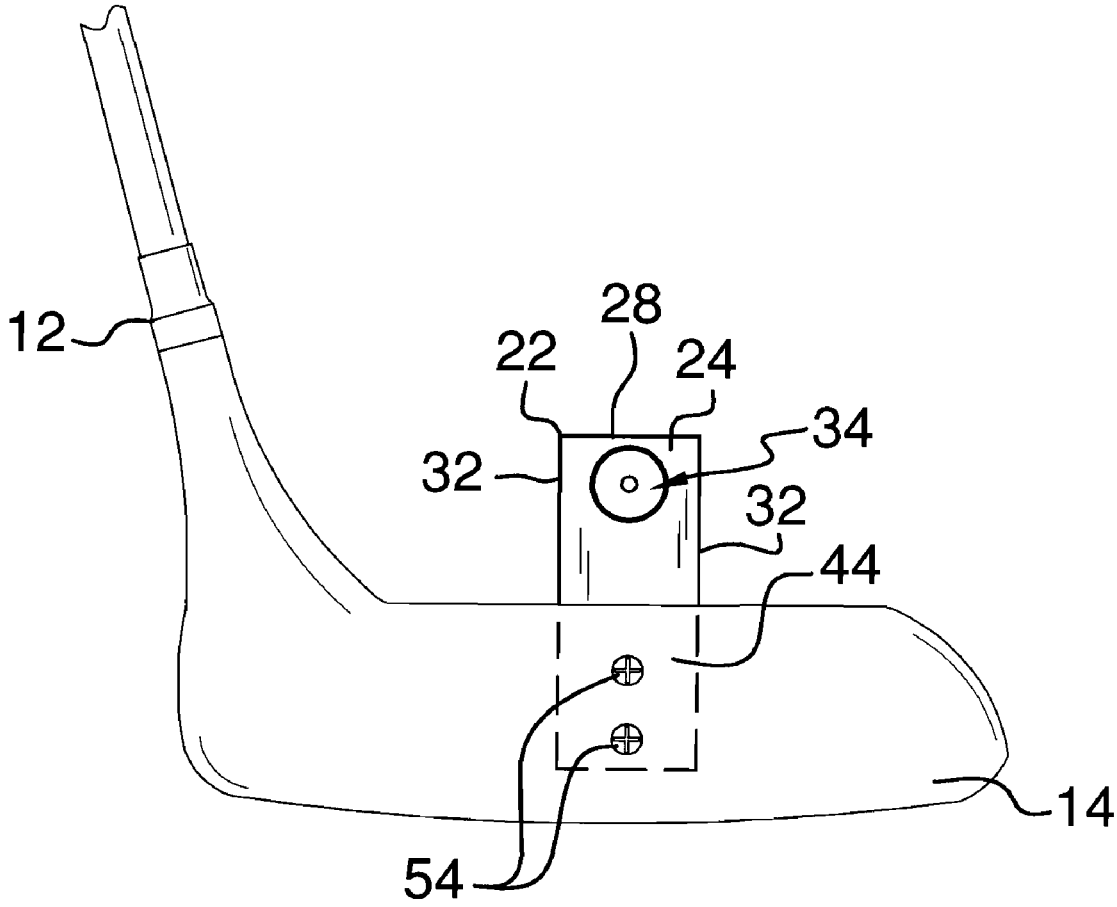
FIG. 4 is a front view of an embodiment of the disclosure.
Figure 5:
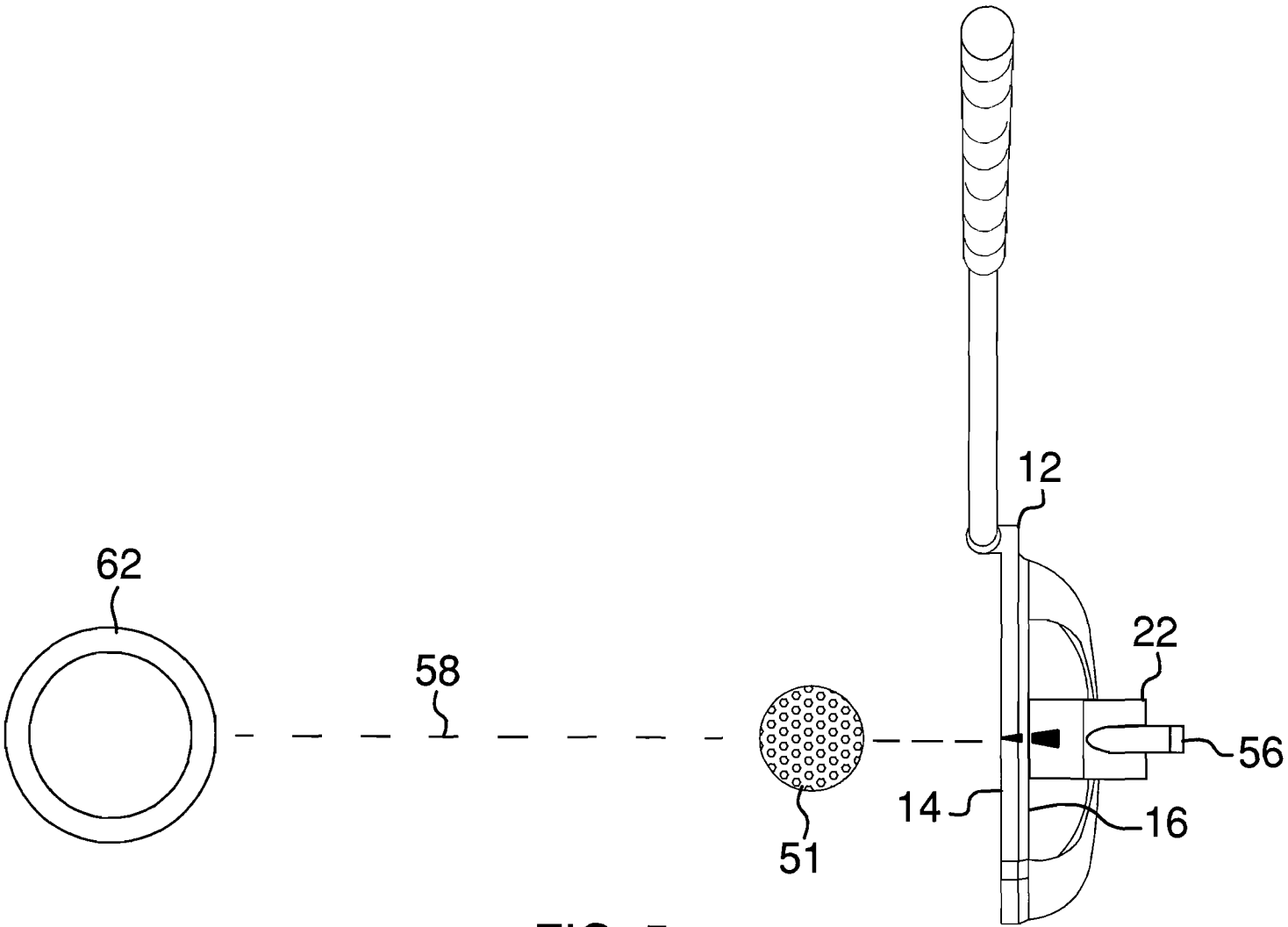
FIG. 5 is a top in-use view of an embodiment of the disclosure

With reference now to the drawings, and in particular to FIGS. 1 through 5 thereof, a new golf putting practice device embodying the principles and concepts of an embodiment of the disclosure and generally designated by the reference numeral 10 will be described.

As best illustrated in FIGS. 1 through 5, the golf putting practice aid assembly 10 generally comprises a golf putter 12 of any conventional design that has a front club face 14 and a rear club face 16. The rear club face 16 has a plurality of fastener apertures 18 extending through it. The fastener apertures 18 have a counter-sink 20 with respect to the front club face 16.

A holding member 22 is provided that has a front side 24, a back side 26, a top side 28, a bottom side 30 and a pair of lateral sides 32 each extending from the top side 28 to the bottom side 30. The front side 24 has a primary laser aperture 34 extending therethrough. The back side 26 has a secondary laser aperture 36 extending therethrough. The holding member 22 is comprised of a rigid material.

A mounting member 38 is provided that has a top wall 40, a bottom wall 42, a front wall 44, a back wall 46 and a pair of lateral edges 48. The top wall 40 is attached to the bottom side 30 adjacent to the front side 24. The front wall 44 is flush against the rear club face 16. The front wall 44 has a plurality of wells 50. Alternatively, the wells 50 can be located on the rear club face 16 and the fastener apertures 18 can extend through the front wall 44 in order to avoid compromising the golf ball 51 striking properties of the front club face 14. The mounting member 38 is configured to elevate the holding member 22 above the front 14 and rear club faces 16 such that a longitudinal axis 52 extending through the primary 34 and secondary laser apertures 36 is horizontally oriented when the front club face 14 is vertically oriented. The mounting member 38 is comprised of a rigid material.

A plurality of fasteners 54 is included. Each of the fastener apertures 18 receives one of the fasteners 54. Each of the fasteners 54 extends into one of the wells 50 to couple the mounting member 38 to the rear face 16. The fasteners 54 can extend through the front face 14 of club or through the rear face 16 of the putter 12. The fasteners 54 may be a screw fastener or other mechanical fastener. A plurality of anchors 60 is inserted into the wells 50. The anchors 60 serve to provide a connection point for the fasteners 54.

A laser light emitter 56 is removably inserted into the secondary laser aperture 36. The laser light emitter 56 is emitting laser light 58 directed forwardly out of the primary laser aperture 34. The laser light emitter 56 can be of any conventional design.

In use, the mounting member 38 is attached to the rear club face 16 using the fasteners 54. The laser light emitter 56 is inserted into the secondary laser aperture 36. Once activated, the laser light emitter 56 will emit a laser light 58 forwardly out of the primary laser aperture 34. Laser light 58 is used to provide an indication of the direction the front club face 14 will send the golf ball 51 upon striking. It will also help to indicate to the user whether or not they are rotating their hands through the striking of the golf ball 52. The golf putter is positioned to direct the laser light towards a golf hole 62 to provide a visual reference of putter alignment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf putting practice aid assembly configured for indicating a club face direction of a putter face, said assembly comprising:

a golf putter having a front club face and a rear club face;

a holding member having a front side, a back side, a top side, a bottom side and a pair of lateral sides each extending from said top side to said bottom side, said front side having a primary laser aperture extending therethrough, said back side having a secondary laser aperture extending therethrough;

a mounting member being attached to said rear face, said mounting member being attached to said bottom side adjacent to said front side, said mounting member being configured to elevate said holding member above said club face;

a laser light emitter being removably inserted into said secondary laser aperture, said laser light emitter emitting laser light directed forwardly out of said primary laser aperture; and an arrow indicia positioned on said golf club and said mounting member, a first portion of said arrow indicia being positioned on a top face of said golf putter, a second portion of said arrow indicia being positioned on a top wall of said mounting member, said first portion of said arrow indicia being aligned with said second portion of said arrow indicia when said mounting member is coupled to said golf club, said arrow indicia being vertically aligned with said laser light emitted from said laser light emitter.

2. The assembly according 1, further including a plurality of fasteners, said rear face having a plurality of fastener apertures extending therein, each of said fastener apertures receiving one of said fasteners, each of said fasteners extending into one of a plurality of wells in said mounting member to couple said mount to said rear face.

3. A golf putting practice aid assembly configured for indicating a club face direction of a putter, said assembly comprising:

a golf putter having a front club face and a rear club face, said rear club face having a plurality of fastener apertures extending therein, said fastener apertures having a counter-sink with respect to said front club face;

a holding member having a front side, a back side, a top side, a bottom side and a pair of lateral sides each extending from said top side to said bottom side, said front side having a primary laser aperture extending therethrough, said back side having a secondary laser aperture extending therethrough, said holding member being comprised of a rigid material;

a mounting member having a top wall, a bottom wall, a front wall, a back wall and a pair of lateral edges, said top wall being attached to said bottom side adjacent to said front side, said front wall being abutting said rear club face, said front wall having a plurality of wells, said mounting member being configured to elevate said holding member above said club face such that a longitudinal axis extending through said primary and secondary laser apertures is horizontally oriented when said front club face is vertically oriented, said mounting member being comprised of a rigid material;

a plurality of fasteners, each of said fastener apertures receiving one of said fasteners, each of said fasteners extending into one of said wells to couple said mount to said rear face;

a laser light emitter being removably inserted into said secondary laser aperture, said laser light emitter emitting laser light directed forwardly out of said primary laser aperture;

a plurality of anchors being inserted into said wells; and an arrow indicia positioned on said golf club and said mounting member, a first portion of said arrow indicia being positioned on a top face of said golf putter, a second portion of said arrow indicia being positioned on a top wall of said mounting member, said first portion of said arrow indicia being aligned with said second portion of said arrow indicia when said mounting member is coupled to said golf club, said arrow indicia being vertically aligned with said laser light emitted from said laser light emitter.

* * * * *